United States Patent [19]

Griffith et al.

[11] 4,269,501

[45] May 26, 1981

[54] DRUM FOR AN AUTOMATIC PHOTOGRAPHIC PROCESSING SYSTEM

[76] Inventors: Glen A. Griffith, 1809 Armour La., Apt. No. 2, Redondo Beach, Calif. 90278; Leroy V. Sutter, Jr., 6301 Summertime La., Culver City, Calif. 90230

[21] Appl. No.: 74,863

[22] Filed: Sep. 12, 1979

[51] Int. Cl.[3] ..... G03D 3/04

[52] U.S. Cl. ..... 354/323; 354/324; 354/330; 366/208

[58] Field of Search ..... 354/297, 323, 324, 329, 354/330; 366/208, 166

[56] References Cited

U.S. PATENT DOCUMENTS

| | | | |
|---|---|---|---|
| 1,288,403 | 12/1918 | Garland | 354/323 |
| 3,682,080 | 8/1972 | Merz | 354/327 |
| 3,703,860 | 11/1972 | Wilkinson | 354/329 |
| 3,709,138 | 1/1973 | Brasher | 354/329 |
| 3,727,535 | 4/1973 | Streeter | 354/325 |
| 3,981,488 | 9/1976 | Ratowsky | 354/329 |
| 3,982,259 | 9/1976 | Baerle | 354/329 |
| 4,035,818 | 7/1977 | King | 354/323 |
| 4,054,902 | 10/1977 | Rebek | 354/329 |
| 4,097,884 | 6/1978 | Lasky et al. | 354/323 |

FOREIGN PATENT DOCUMENTS

| | | | |
|---|---|---|---|
| 1906367 | 9/1970 | Fed. Rep. of Germany | 354/329 |
| 2047864 | 4/1972 | Fed. Rep. of Germany | 354/329 |

*Primary Examiner*—Michael L. Gellner
*Assistant Examiner*—Alan Mathews
*Attorney, Agent, or Firm*—W. Edward Johansen

[57] ABSTRACT

The present invention is an improved drum mechanism for use in combination with an automatic photographic processing system which includes a housing, a bi-directional motor that has a shaft and that is mounted on the housing, a control unit for controlling the bi-directional motor and a drain tray that is mounted on the housing. The automatic photographic processing system also includes a fluid injector unit for injecting fluids into said improved drum mechanism that is electrically coupled to the control unit and that is mounted on the housing. The improved drum mechanism includes an elongated, cylinder-shaped member which is adapted to receiver photographic print materials and which is fluidly coupled to the fluid injector unit and a drum mounting that includes a set of four rollers, one of which is mechanically coupled to the shaft of the bi-directional motor and which is mechanically coupled to the elongated, cylinder-shaped member, and that is mechanically coupled to the housing adjacent to the drain tray so that when the elongated, cylinder-shaped member is placed on the set of four rollers it can be bi-directionally rotated by the bi-directional motor. The improved drum mechanism has a draining apparatus which is a slot which travels longitudinally along the sidewall of the elongated cylinder-shaped member and which may be disposed parallelly above the drain tray.

2 Claims, 5 Drawing Figures

Fig. 1.
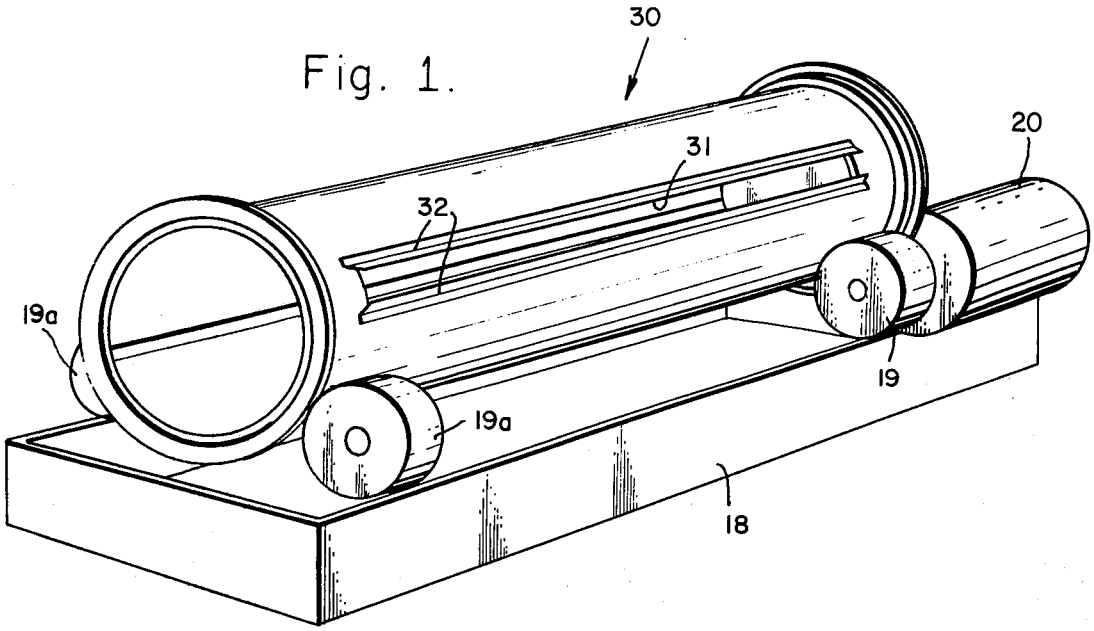
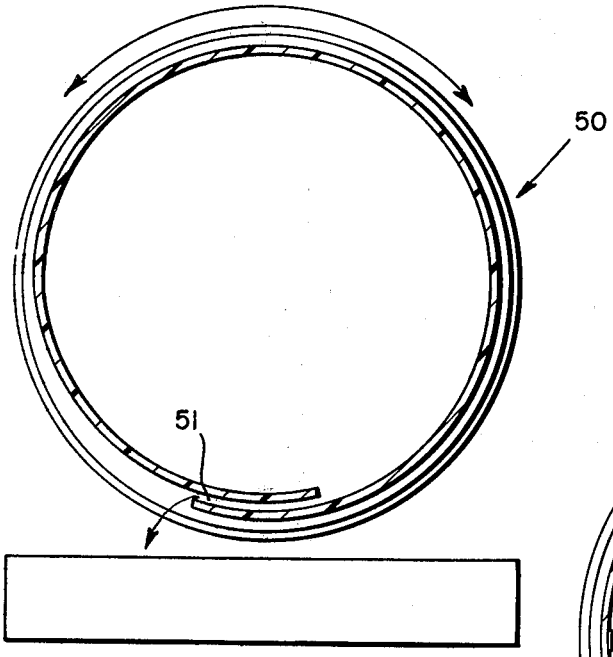
Fig. 5.
Fig. 4.
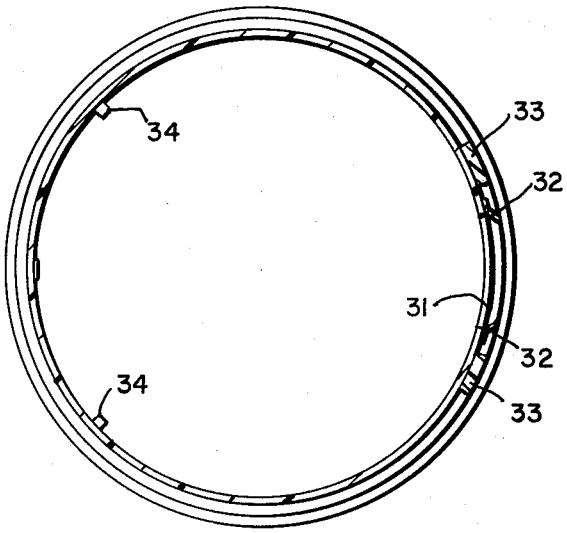

DRUM FOR AN AUTOMATIC PHOTOGRAPHIC PROCESSING SYSTEM

BACKGROUND OF THE INVENTION

1. Field of the Invention

The present invention relates to a drum for use in combination with an automatic photographic processing system and more particularly to a slotted drum which allows a single bi-directional motor to perform the functions of agitation, retention and fluid drainage.

2. Description of the Prior Art

U.S. Pat. No. 4,035,818, entitled Color Print or Film Processor, issued to Roger A. King on July 12, 1977, teaches an automatic photographic developing apparatus in which the photographic developing apparatus in which the photographic material to be developed is placed in a cylindrical drum. The drum is laid on its side on a set of rollers, one of which causes it to rotate. A plurality of containers for various photographic liquids are provided with valve arrangements by which their contents are delivered either in total or in measured increments to the rotating drum. The drum is mounted in a cradle so that it can be tilted to drain liquids from it. Specific details are given of the drum, its driving and cradle tilting components, the liquid dispensing and metering components, and the program control apparatus whereby the photographic materials may be treated with selected solutions in selected orders for predetermined intervals.

U.S. Pat. No. 3,727,535, entitled Photographic Processing Apparatus, issued to Robert G. H. Streeter on Apr. 17, 1973, teaches an apparatus for processing photographic materials such as film or paper prints which include an elongated horizontal housing having a top wall provided with an access opening sealed by a lid, a horizontal cylindrical drum mounted in the housing for rotation on its longitudinal axis, a solution tray pivotally mounted in the housing below and drum for movement between an operative position and a dumping position for discharging spent solution, and a distribution pipe for supplying treatment solution to the tray. The drum is provided with an opening in its periphery having two parallel rims extending along the longitudinal axis of the drum and a scooping lip mounted on one of the said rims. The sheets of photographic material are placed in the drum through the opening and the sheets are secured inside the drum by adjustable bars detachably fixed on the inside periphery of the drum. The drum is then continuously rotated about its horizontal axis and a predetermined amount of treatment solution fed into the tray. As the drum rotates the scooping lip scoops up the solution into the drum so that the photographic sheets are continuously brought into contact with the solution. The tray is then tilted to discharge the solution and a succession of treatment solutions are fed into the tray in the foregoing manner until the photographic sheets are processed.

U.S. Pat. No. 3,682,080, entitled Apparatus for Developing Photographic Films, issued to Werner Merz on Aug. 8, 1972, teaches an apparatus for developing photographic films which includes one or more drums which have spaced opposite ends that are mounted for rotation in a housing and a supply supplies liquid developer to the interior of these drums. Raising arrangement utilizing eccentric cams or the like is provided for alternately raising or lowering one end of each drum at predetermined time intervals and through a predetermined distance to thereby cause longitudinally traveling waves of the developer in the drums.

U.S. Pat. No. 3,703,860, entitled Apparatus for Photographic Processing, issued to Peter R. S. Wilkinson on Nov. 28, 1972, teaches a drum photographic processor which is adapted to rotate horizontally but to be tilted to evacuate processing solution while still being rotated. The direction of rotation may be changed as well as the degree of tilting. A longitudinal slot within the drum serves to engage a leading edge of photographic film being processed and to assist in the desired flow of processing solution. Various devices to cause automatic evacuation of processing solution or tilting the drum are described.

U.S. Pat. No. 3,982,259, entitled Photographic Material Processing Module, issued to Edward Van Baerle on Sept. 21, 1976, teaches a photographic material processing module which is usable alone for all the processing procedure, or with like modules in side-by-side relation, each module performing one or more of the processing steps. Exposed photographic material is mounted in a cylindrical container having at one end a cover provided with an opening for receiving and discharging processing liquids. The module has a mechanical arrangement for rotating the container a few revolutions in one direction followed by a few revolutions in the opposite direction, and, in preferred form, a mechanism for simultaneously reciprocating the container axially, such movements providing optimum shear relation between processing liquid and photographic material for streak-free processing. A liquid supplying system is provided for feeding measured amounts of processing liquid at proper temperature into the container, and for elevating one end of the container to discharge the processing liquid at the conclusion of a timed processing step. Finally, the module has a transport device for moving the container from the module to an adjacent module at the conclusion of the processing step or steps performed in that module.

U.S. Pat. Nos. 4,035,818; 3,727,535; 3,682,080; 3,703,860; and 3,982,259 all teach photographic film processing systems which have mechanisms for tilting the drums containing the photographic film in order to drain the processing liquid from the drums. These mechanisms are relatively mechanically complex compared to a single bi-directional motor.

U.S. Pat. No. 3,709,138, entitled Photographic Print Processing Apparatus, issued to Leonard E. Brasher on Jan. 9, 1973, teaches a photographic print processing apparatus which includes a rotatable drum into which may be introduced a quantity of photographic print processing fluid. A device is provided for controllably introducing the processing fluid into the drum and for controllably introducing water or other appropriate fluid for the washing of photographic printing papers at appropriate stages during the development process. The apparatus may be powered manually or may be provided with a motor drive mechanism to achieve selective rotation of the drum during processing. The drum may be rotated in one direction for processing and may be rotated in the opposite direction for expelling the processing fluid from the drum into a reservoir provided to contain the expelled fluid. Selective directional rotation of the drum may be achieved by the reversible electric motor that may be actuated by mercury switches positioned on an actuating lever which switches are selectively actuated to energize the motor depending upon relative positioning of the lever as the lever is actuated for control purposes.

U.S. Pat. No. 4,054,902, entitled Apparatus for Developing Photographic Prints, issued to Dennis C. Rebek on Oct. 18, 1977, teaches an apparatus for developing photographic prints which is housed in a cabinet and which includes a developing tank, a removable hood for covering the developing tank, a removable hood for covering the developing tank against the entrance of light, a print holding fixture mounted for rotation relative to the developing tank, and a plurality of containers of compartments for storing developing reagents and rinse water. The print holding fixture includes mounting units which are adapted to contact only the opposite outer edge portions of a print and hold it in a plano-arcuate shape with the image or exposed side facing inwardly. The cabinet includes a chamber which jackets or surrounds a major portion of the developing tank and holds warm water for tempering developing reagents and rinse water container in the developing tank. The developing reagent and rinse water containers or compartments are connected to the developing tank by individual conduits including intermediate portions which are located in the lower portion of the chamber and mounted in a coiled fashion so that the warm water tempers the developing reagents and the rinse water prior to their introduction into the developing tank. The apparatus also includes control valves for selectively admitting each reagent and the rinse water into the developing tank and a drain valve for draining the developing tank so that, after installation of a print or prints on the holding fixture, the entire development process can be performed in a lighted room.

U.S. Pat. No. 1,288,403, entitled Photographic Developing Apparatus, issued to William F. Garland on Dec. 17, 1918 teaches a system for developing photographic prints. U.S. Pat. No. 3,981,488, entitled Carrier for Processing Photographic Materials and Apparatus for Rotating the Carrier, issued to Simon Ratowsky on Sept. 21, 1978, teaches an apparatus for axially rotating and vertically oscillating a horizontally disposed cylindrical carrier for processing photographic material, the carrier having a ring projecting longitudinally from at least one end thereof, to form an internal trackway.

In all of the above described photographic film processing systems there are mechanisms for tilting the drums in order to drain the processing liquid from them. These mechanisms require many moving parts such as levers, gears, pulleys or cams which must be machined within close tolerances. Furthermore their drum geometry require large volume of the processing liquids in order to contact the photographic paper.

SUMMARY OF THE INVENTION

In view of the foregoing factors and conditions characteristic of the prior art, it is the primary object of the present invention to provide an improved drum for use in combination with an automatic photographic processing system which has a drum geometry which is a minimum fluid processor and does not require a large volume of fluid in order for the fluid to contact the paper.

It is another object of the present invention to reduce the number of moving parts of an automatic photographic processing system in order to simplify the system and to reduce its cost.

It is still another object of the present invention to provide an improved drum for use in combination with an automatic photographic processing system that does not require a mechanism to tilt it in order to drain the processing liquid from thereby reducing the size of the enclosure for the system.

It is yet still another object of the present invention to provide an improved drum for use in combination with an automatic photographic processing system that does not intricate fins or sealing structures which must be carefully added to the drum structure during its manufacturing.

It is still yet another object of the present invention to provide an improved drum for use in combination with an automatic photographic processing system that introduces modularity and portability to the system.

In accordance with an embodiment of the present invention an improved mechanism for use in combination with an automatic photographic processing system which includes a housing, a bi-directional motor that has a shaft and that is mounted on the housing, a control unit for controlling the bi-directional motor and a drain tray that is mounted on the housing is described. The automatic photographic processing system also includes a fluid injector unit for injecting fluids into said improved drum mechanism that is electrically coupled to the control unit and that is mounted on the housing. The improved drum mechanism includes an elongated, cylinder-shaped member which is adapted to receive photographic print materials and which is fluidly coupled to the fluid injector unit and a drum mounting that includes a set of four rollers, one of which is mechanically coupled to the shaft of the bi-directional motor and which is mechanically coupled to the elongated, cylinder-shaped member, and that is mechanically coupled to the housing adjacent to the drain tray so that when the elongated, cylinder-shaped member is placed on the set of four rollers, it can be bi-directionally rotated by the bi-directional motor. The improved drum mechanism has a draining apparatus which is a slot which travels longitudinally along the sidewall of the elongated cylinder-shaped member and which may be disposed parallelly above the drain tray.

The features of the present invention which are believed to be novel are set forth with particularity in the appended claims.

Other objects and many of the attendant advantages of this invention will be more readily appreciated as the same becomes better understood by reference to the following detailed description and considered in connection with the accompanying drawing in which like reference symbols designate like parts throughout the figures.

DESCRIPTION OF THE DRAWING

FIG. 1 is a perspective drawing of an improved drum for an automatic photographic processing system which has been constructed in accordance with the principles of the present invention.

FIG. 4 is a cross-sectional view of the improved drum of FIG. 1 taken along the line 4—4 of FIG. 3.

FIG. 5 is a cross-sectional view of a second embodiment of an improved drum which may also be incorporated into the automatic photographic processing system.

DESCRIPTION OF THE PREFERRED EMBODIMENT

Figure 2:
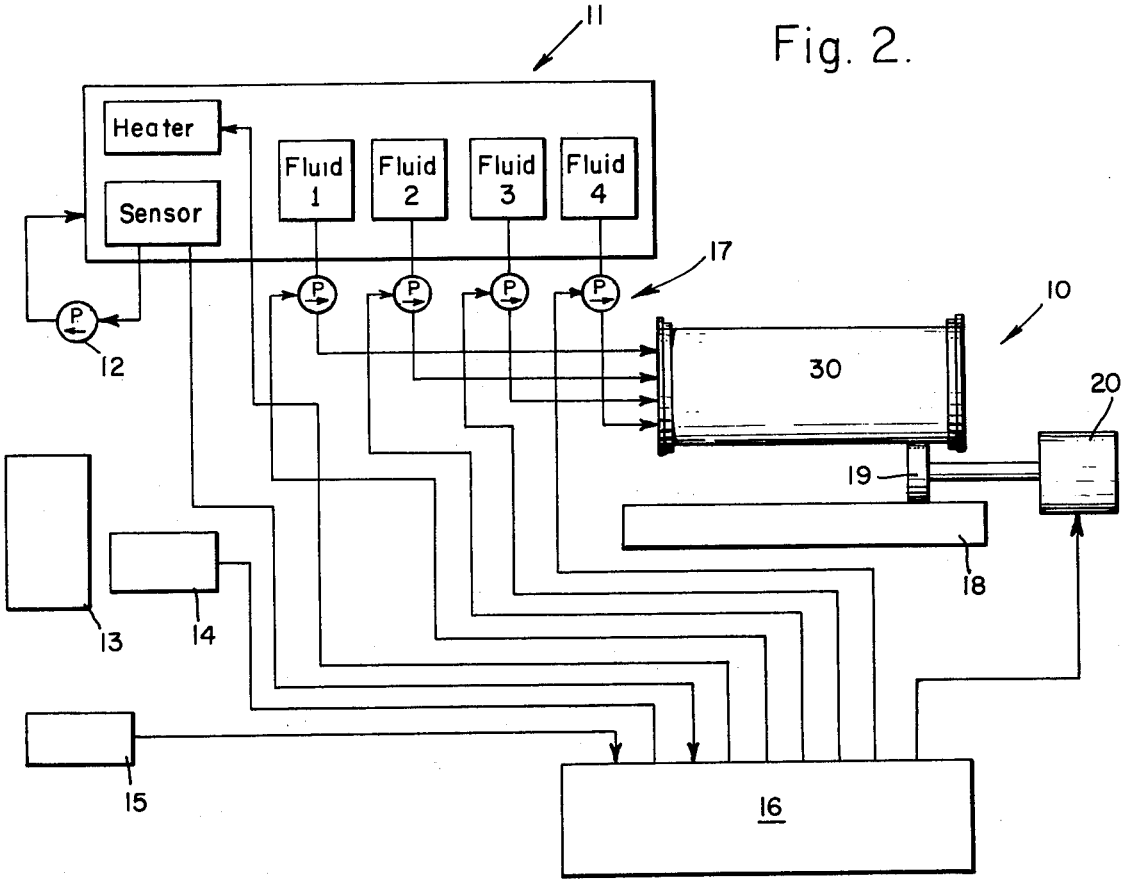
FIG. 2 is a schematic diagram of the automatic photographic processing system which incorporates the improved drum of FIG. 1.
Figure 3:
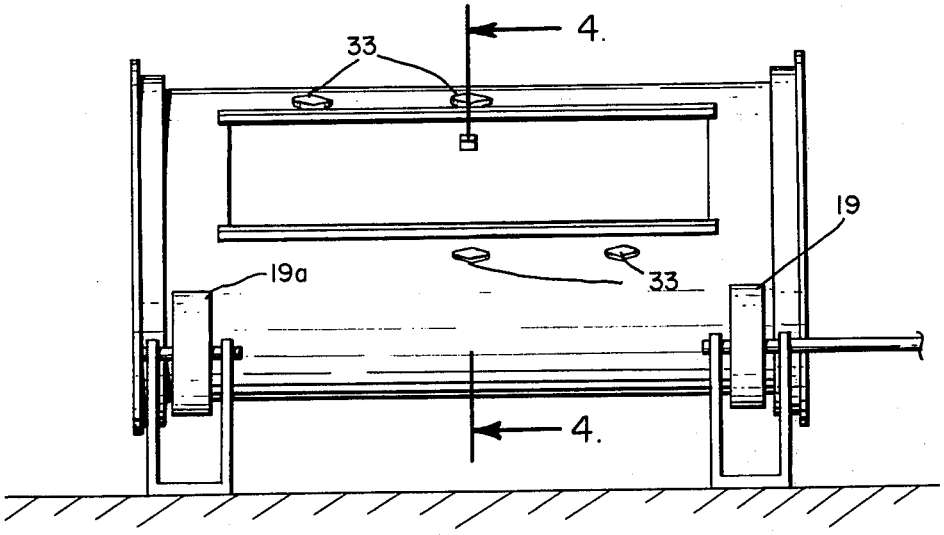
FIG. 3 is an elevational view of the improved drum of FIG. 1.

In order to best understand the present invention, it is necessary to refer to the following description of its preferred embodiment in conjunction with the accompanying drawing. Referring to FIG. 1 in conjunction with FIG. 2 an automatic photographic processing system 10 includes a fluid injector unit 11, which injects photographic processing solutions into an improved drum mechanism, a water circulating pump 12 which is fluidly coupled to the sensor of the fluid injector unit 11, an air circulating fan 13, an air heater 14 and an air temperature sensor 15. The automatic photographic processing system 10 also includes a control unit which has a program module and which is electrically coupled to the water temperature sensor of the fluid injector unit 11, the air heater 14 and the air temperature sensor 15. The fluid injector unit 11 has a set of four different fluid containers which are disposed in a water bath. The automatic photographic processing system further includes a set of four injector pumps 17 each of which have injector nozzles.

The automatic photographic processing system 10 further includes a drain tray 18 which is incorporated into the housing thereof, a set of rollers, including a drive roller 19 and a pair of rollers 19*a*, and a bi-directional motor 20 which is electrically coupled to the control unit 16 and mechanically coupled to the drive roller 19.

Referring still to FIG. 1 the automatic photographic processing system 10 further includes an improved drum mechanism which includes an elongated cylinder-shaped member 30 which receives photographic print materials. The elongated, cylinder-shaped member 30 is fluidly coupled to the fluid injector unit 11 and it has slot 31 which travels longitudinally along the sidewall and which may be disposed parallelly above the drain tray 18. The elongated, cylinder-shaped member 30 also a pair of lips 32 which are parallelly disposed adjacent to the slot 31 thereof so that photographic processing fluids will not splash out of the elongated, cylinder-shaped member 30 through the slot 31 therein. The elongated cylinder-shaped member 30 further includes a set of position detectors 33 which are mounted on the cylindrical sidewall thereof.

The inventors note that the "scooping lip", which is a flared lip 35, of U.S. Pat. No. 3,727,535, described in the description of prior art, is used to scoop up the processing solution from an open solution tray 37 into the drum 25 of U.S. Pat. No. 3,727,535. The open solution tray is pivotally mounted so that both the drain tray 37 and the drum 25 can be drained into a drain pipe 24 by aligning the slot 32 in the drum 25 so that it is facing vertically downward and by then pivoting the open solution tray 37 to its inoperative position. In contrast to the drum mechanism of the photographic processing system of U.S. Pat. No. 3,727,535, the inventors further note that the improved drum mechanism that they have described in this application is much simpler mechanically in that the draining of the drum mechanism is performed by the single-bi-directional motor 20.

The unique feature of the system is the slotted drum, which allows a single reversible motor to perform the functions of agitation, retention, and fluid drainage without additional apparatus. Developing fluids are injected into the open end of the drum which contains the exposed photographic paper. The reversible motor rolls the drum in alternate directions, allowing the developing fluids to interact with the photographic paper, but not in such a fashion so as to allow the fluids to flow down and out through the slot. Fluids are drained from the drum by rolling the drum until the slot is fully down, thereby allowing the fluid to completely drain.

The drum rests on four rollers, and is prevented from slipping off by the shouldered collars on the drum ends. The drum is friction driven by one of the rollers which is directly mounted to the shaft of the reversible motor. This design therefore allows the drum to be easily removed without the need to disengage any retention hardware.

Among the advantages of the first embodiment of the improved drum mechanism is that the drum geometry is a minimum fluid processor. It does not require a large volume of fluid to create a reservoir necessary to contact the paper. Another advantage is that the drum represents the only moving part in the system 10 other than pumps and motors excluded. There are no levers, gears, pulleys or cams which must be closely machined. This is a significant cost reducing factor. There are no intricate fins or sealing surfaces which must be carefully added to the drum structure. Since the drum does does not tip, there is a significant reduction in the size of the processor enclosure. This is, again, a manufacturing savings.

Referring now to FIG. 5 a second embodiment of the improved drum mechanism includes an elongated, cylinder-shaped member 50 having an over-lapping slot 51 which drive roller 19, which the bi-directional motor 20 drives, drives on the drive roller and freely—rollers 19*a*. Among the added advantages of this second embodiment is that the relative position of the drum with respect to the processor is not important, which is not the case with the slotted drum 30. Thus the accompanying electrical and/or mechanical mechanism by which the position of the drum is controlled, as in the slotted drum 30, is not necessary in the overlapping drum concept which simplifies the design of the automatic photographic processing system 10. Another advantage is that the cascading of the liquids over the inner lip of the drum 50 during clockwise rotation creates turbulence in the liquid thereby maintaining homogeneity of the chemistry. After cascading, the liquid returns to a laminar, non-turbulent condition by viscous interaction of the liquid and the wall in the region between the cascade and the leading edge of the paper. Laminar flow of the liquid over the paper is critical in uniform processing of the paper.

By using the improved drum mechanism the inventors have been able to improve the system by providing complete control of air and fluid temperature. The use of the improved drum mechanism in the photographic processing system provides complete program flexibility in that different processes and modification to existing brand name procedures are accomplished by user interchangeable modules.

From the foregoing it can be seen that an improved drum mechanism for an automatic photographic processing system has been described. Accordingly, it is intended that the foregoing disclosure and showing made in the drawing shall be considered only as illustrations of the present invention. Furthermore, it should be noted that the sketches are not drawn to scale and that distances of and between the figures are not to be considered significant. The invention will be set forth with particularity in the appended claims.

What is claimed is:

1. An improved drum mechanism for use in combination with an automatic photographic processing system which includes:

a. a housing;

b. a bi-directional motor which has a shaft and which is mounted on the housing;

c. a control unit for controlling the bi-directional motor which is electrically coupled to the bi-directional motor;

d. a drain tray which is mounted on the housing; and e. a fluid injector unit for injecting fluids into said improved drum mechanism which is electrically coupled to the control unit and which is mounted on the housing, said improved drum mechanism comprising:

a. an elongated, cylinder-shaped member which is adapted to receive photographic print materials and which is fluidly coupled to the fluid injector unit, said elongated, cylinder-shaped member having a a slot which travels longitudinally along its sidewall so that it forms a drain for draining the fluid from said elongated, cylinder-shaped member;

b. a pair of lips which are disposed parallel and adjacent to said slot so that the fluid will not splash out of said elongated, cylinder-shaped member thereby contaminating the fluids;

c. a drum mounting including a set of four rollers, one of which is mechanically coupled to the shaft of the bi-directional motor, which is mechanically coupled to the housing adjacent to the drain tray so that when said elongated, cylinder-shaped member is placed on said set of four rollers it can be bi-directionally rotated by the bi-directional motor.

2. An improved drum mechanism according to claim 1 wherein said improved drum mechanism also comprises:

a. position-sensing means for sensing the position of said slot with respect to the drain tray; and b. controlling means for controlling the bidirectional motor in response to a signal from said position-sensing means so that the bidirectional motor can agitate the solution in said elongated, cylinder-shaped member by driving it clockwise and counterclockwise in such a manner that said slot is not disposed over the drain plate until the solution is ready to be drained.

* * * * *